US010280938B2

(12) United States Patent
Nawrocki

(10) Patent No.: US 10,280,938 B2
(45) Date of Patent: May 7, 2019

(54) MOTORCOMPRESSOR UNIT WITH VARIABLE AERODYNAMIC PROFILE

(75) Inventor: Gilles Nawrocki, La Breuil (FR)

(73) Assignee: THERMODYN, Le Creusot (FR)

( * ) Notice: Subject to any disclaimer, the term of this patent is extended or adjusted under 35 U.S.C. 154(b) by 0 days.

(21) Appl. No.: 13/339,389

(22) Filed: Dec. 29, 2011

(65) Prior Publication Data

US 2012/0171056 A1 Jul. 5, 2012

(30) Foreign Application Priority Data

Dec. 31, 2010 (FR) ..... 10 61391

(51) Int. Cl.

| | |
|---|---|
| ***F04D 25/06*** | (2006.01) |
| ***F04D 27/02*** | (2006.01) |
| ***F04D 29/42*** | (2006.01) |
| ***F04D 29/56*** | (2006.01) |
| ***F04D 29/46*** | (2006.01) |

(52) U.S. Cl.

CPC ..... *F04D 29/462* (2013.01); *F04D 25/06* (2013.01); *F04D 27/0246* (2013.01); *F04D 29/4206* (2013.01); *F04D 29/563* (2013.01); *F05D 2250/51* (2013.01); *F05D 2250/52* (2013.01)

(58) Field of Classification Search

CPC ..... F04D 25/16; F04D 29/403; F04D 29/42; F04D 29/4206; F04D 29/44; F04D 29/441; F04D 29/444; F04D 29/5806; F04D 29/462; F04D 27/0246; F04D 29/46; F04D 29/54; F04D 29/56; F04D 29/563

USPC ..... 417/253, 295, 279, 423.1

See application file for complete search history.

(56) References Cited

U.S. PATENT DOCUMENTS 2,770,106 A * 11/1956 Moody ..... F25B 1/10 62/505
3,160,392 A * 12/1964 Hunter ..... F01D 17/143 415/151
4,027,997 A * 6/1977 Bryans ..... F04D 29/441 415/207
4,219,305 A * 8/1980 Mount ..... F01D 17/143 415/13

(Continued)

FOREIGN PATENT DOCUMENTS

EP 2006494 A1 12/2008
WO 9429597 A1 12/1994

(Continued)

OTHER PUBLICATIONS

EPO Form 1503, FR dated Aug. 10, 2011, French Search Report for FR1061391.

*Primary Examiner* — Bryan M Lettman
(74) *Attorney, Agent, or Firm* — GE Global Patent Operation; Robert D. Crawford, II

(57) ABSTRACT

A motorcompressor unit includes a first motor driving the rotation of a rotor and a compression stage including a bladed impeller mounted on a driven shaft, the rotation of which is driven by the rotor. Also, common casing is gastight with respect to fluid handled by the motorcompressor unit, where the compression stage and the first motor are mounted in the common casing. The compression stage also includes a regulating member that regulates the angle at which the fluid flows to or from the bladed impeller, and a second motor that controls the regulating member, the second motor being mounted in the common casing.

20 Claims, 2 Drawing Sheets

(56) References Cited

U.S. PATENT DOCUMENTS 4,257,733 A * 3/1981 Bandukwalla ..... F04D 29/464 415/13
4,460,310 A * 7/1984 Plunkett ..... F01D 17/143 415/158
4,503,684 A * 3/1985 Mount ..... F04D 27/0246 415/14
4,877,369 A * 10/1989 Bandukwalla ..... F01D 17/143 415/148
5,452,986 A * 9/1995 Osborne ..... F04D 29/462 415/150
5,618,160 A * 4/1997 Harada ..... F04D 27/0246 415/15
5,683,223 A * 11/1997 Harada ..... F04D 27/02 415/17
5,873,696 A * 2/1999 Harada ..... F04D 27/0246 415/148
5,895,204 A * 4/1999 Sishtla ..... F04D 29/464 415/148
5,947,680 A * 9/1999 Harada ..... F04D 27/0284 415/17
6,129,511 A * 10/2000 Salvage ..... F01D 17/02 415/1
6,506,011 B1 * 1/2003 Sishtla ..... F04D 29/462 415/1
7,144,226 B2 * 12/2006 Pugnet ..... F04D 17/125 417/244
7,824,148 B2 * 11/2010 Tetu ..... F04D 27/0246 415/1
2005/0223737 A1 * 10/2005 Conry ..... 62/510
2009/0196741 A1 * 8/2009 Tsukamoto ..... F04D 17/122 415/159
2009/0205360 A1 * 8/2009 Haley ..... F04D 17/122 62/498
2010/0172753 A1 * 7/2010 Lin ..... F04D 29/441 415/208.1
2013/0272864 A1 * 10/2013 Shioda ..... F04D 29/4206 415/203

FOREIGN PATENT DOCUMENTS

WO 03072946 A1 9/2003
WO 2007055589 A1 5/2007
WO 2008045413 A2 4/2008

* cited by examiner

MOTORCOMPRESSOR UNIT WITH VARIABLE AERODYNAMIC PROFILE

RELATED APPLICATION

This application claims priority to French application Ser. No. FR 1061391, filed Dec. 31, 2010, the entire disclosure of which is incorporated herein by this reference.

The invention relates to centrifugal motorcompressor units and, more particularly, to centrifugal compressor units of the integrated type in which the compressor and a motor means of driving the compressor are mounted in a common casing that is sealed against the gas handled by the compressor.

A conventional integrated compressor unit comprises a motor means, generally consisting of an electric drive motor, and a centrifugal compressor comprising one or more compression stages depending on the application.

Each compression stage comprises a bladed impeller mounted on a driven shaft driven by a rotor which is itself driven by the motor.

In certain applications, and in particular for low-pressure applications, it has been proposed for use to be made of blades with variable pitch vanes so as to modify the work developed by the compression stage to suit the gas flow rate.

In order to modify the orientation of the vanes, use is made of mechanical devices, for example by fitting the vanes with crown gears driven by worm-type devices.

A motor external to the casing is then used to operate the mechanical device that controls the orientation of the vanes. Such an arrangement entails making holes in the body of the rotary machine and the consequential use of sealing devices. Now, providing holes in the casing of a compressor considerably limits the range in which the compressor can be used, which range remains dedicated to low, or sometimes medium, pressures, which means to say pressures of below around 20 bar.

It is an object of the invention therefore to alleviate this disadvantage and to propose an integrated motorcompressor unit with variable aerodynamic profile, which means to say one capable of modifying the flow of gas within the compression stages, and of doing so over a broader range of pressures.

The invention therefore proposes a compressor unit comprising at least one motor driving the rotation of a rotor and at least one compression stage comprising a set of bladed impellers mounted on a driven shaft the rotation of which is driven by the rotor, the ensemble comprising the motor and the or each compressor being mounted in a common casing that is gastight with respect to the gas handled by the compressor unit.

According to one general feature of this compressor unit, at least one of the compression stages comprises at least one aerodynamic member for regulating the angle of incidence of the flow of gas through the said stage and a motor for controlling the said regulating member mounted in the common casing. For preference, the regulating member is able to vary the flow angle of gas arriving at a bladed impeller, or leaving a bladed impeller. According to one first embodiment alternative, the member is capable of varying the angle of incidence of the flow of gas arriving at at least one bladed impeller. According to another embodiment variant, the member is capable of varying the flow angle of gas leaving a bladed impeller, for example progressing towards a diffuser.

Because the motor that controls the aerodynamic member is incorporated into the casing, the holes in the casing through which the mechanical regulating member passes can be dispensed with, so that the casing therefore remains sealed allowing the motorcompressor unit to operate at higher pressures.

It has been found in particular that, thanks to such an arrangement, the operating range of the motorcompressor unit could be extended out to values of the order of 60 to 80 bar.

According to another feature, the regulating member comprises a vane arranged across a diameter of a gas passage in the compression stage. The regulating member may for example comprise a number of radial vanes, each of a length shorter than or equal to half the diameter of the gas passage. The vanes can thus be actuated simultaneously for example by mechanical devices such as one or more crown gears driven by devices of the worm type. For preference, the regulating member is configured so that it is possible to obtain at least three different angles of incidence or of departure of gaseous flow towards a bladed impeller or from a bladed impeller.

According to yet another feature, the motorcompressor unit comprises between one and three compression stages, preferably one compression stage, at least one of the said stages being provided with the regulating member.

When the compressor unit comprises several compression stages, provision may be made for the flow to be modified by means of an aerodynamic member provided at each stage.

Each regulating stage comprises, in succession, in the direction in which the handled gas flows, a gas supply zone, a bladed compression impeller and a diffuser. The regulating member may then be positioned upstream of the bladed impeller.

As an alternative, it may be arranged in the diffuser.

Another variant involves simultaneously installing a regulating member upstream of the compression stage and a regulating member in the diffuser.

According to yet another feature, the motorcompressor unit further comprises an electronic control unit external to the casing and connected to the control motor by supply and control cables that pass through the casing at fluidtight lead-throughs.

Other objects, features and advantages of the invention will become apparent from reading the following description, given solely by way of nonlimiting example, and made with reference to the attached drawings, in which.

Figure 1:
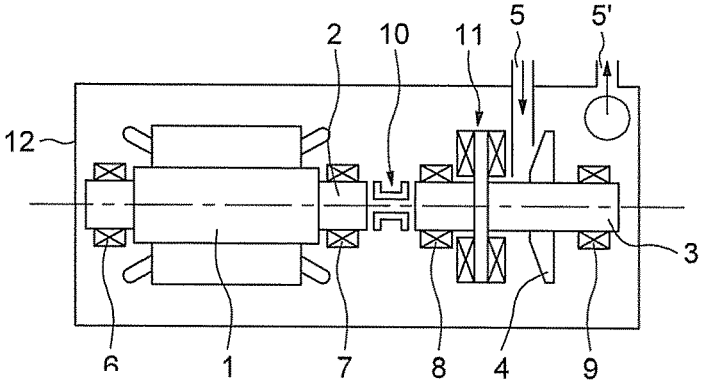
FIG. 1 is a schematic view showing the overall design of a single-stage compressor unit.

The motorcompressor unit illustrated in FIG. 1 essentially comprises a motor 1, consisting for example of a variable-speed electric motor driving the rotation of a rotor 2, which itself at the same speed drives a driven shaft 3 on which a bladed impeller 4 is mounted.

As can be seen, the motorcompressor unit thus comprises a single compression stage consisting of the centrifugal bladed impeller 4 which draws in a gas which is delivered from a supply pipe 5 in order to increase its pressure and deliver it at outlet 5'.

In the embodiment depicted, the rotor 2 is supported by two end bearings 6 and 7. Such is also the case of the driven shaft 3 which is likewise supported by two end bearings 8 and 9. Thus, with this arrangement, the rotor 2 and the driven shaft 3 are connected by a flexible coupling 10.

However, it would not constitute a departure from the scope of the invention if the rotor and the driven shaft were to be connected by a fixed coupling. In such a case, one of the bearings such as 7 and 8 could be omitted.

However, the arrangement depicted is advantageous because it considerably simplifies the assembly of the compressor unit by, in particular, eliminating the problems of aligning the rotor with the driven shaft.

It may also be seen that the motorcompressor unit is also provided with a thrust bearing 11 that limits the axial movement of the driven shaft 3 under the action of the rotation of the impeller 4.

Finally, the assembly, which means to say the motor 1 and the compression stage, is arranged in a common casing 12 which is sealed against the gas handled by the compressor. In other words, the motor 1 here is at the intake pressure of the motorcompressor unit.

Figure 2:
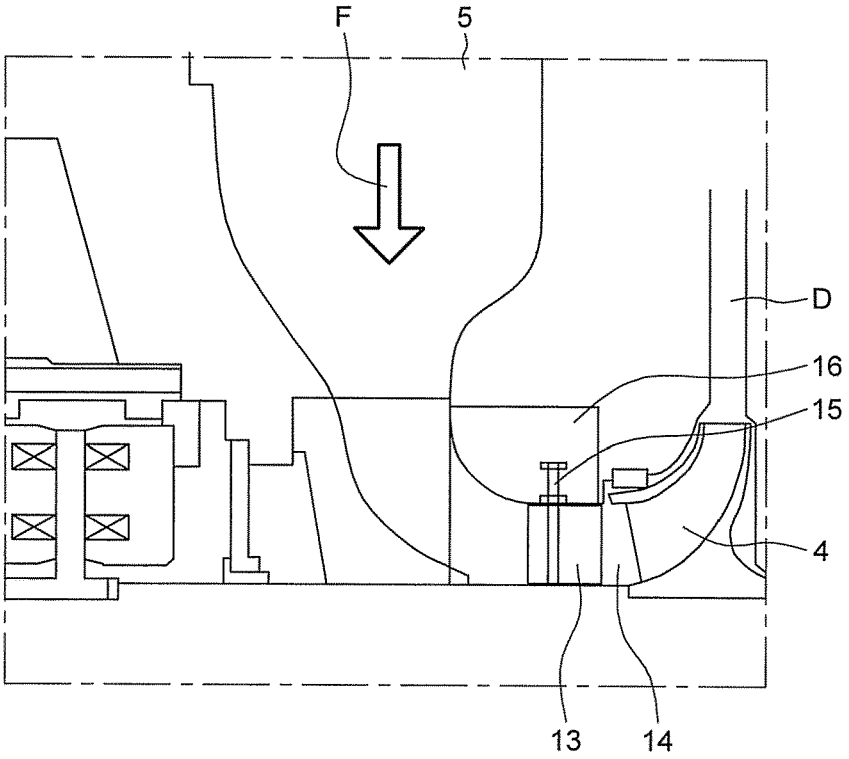
FIG. 2 is a detailed view of the compressor unit of FIG. 1, showing the aerodynamic regulating member.

FIG. 2 depicts a detailed view of the motorcompressor unit of FIG. 1.

This figure shows the gas intake orifice 5 via which the gas to be compressed is drawn in in the direction of the arrow F, and the impeller 4 which actually compresses the gas in order to deliver it, downstream, to a diffuser D in which the gas is slowed down in order to increase its pressure before it is delivered at outlet.

Upstream of the impeller 4, the compressor is provided with a regulating member, referenced 13, produced in the form of a vane mounted across a diameter of a gas passage 14 running between the intake orifice 5 and the impeller 4. This vane constitutes an aerodynamic element which makes it possible to control the angle of the flow and keep it optimum over a wide range of flow rates. As will be seen, this vane 13 is mounted on a control rod 15 which is turned by a control motor 16, for example a stepping motor incorporated into the motorcompressor, which means to say arranged inside the common casing 12. The motor 16 is electrically powered from outside the motorcompressor and is operated by a central control unit (not depicted) which causes the motor to turn and accordingly orients the vane 13 in the passage 14 in such a way as to shift the operating curve of the motorcompressor.

Of course, the supply and control cables that connect the control motor and the central control unit pass through the casing 12 at lead-throughs (not depicted) that are sealed against the gas handled by the motorcompressor in such a way as to maintain a level of sealing that is far superior to the seals required at the penetrations for the mechanical devices according to the state of the art, when the motor is located outside the casing.

Figure 3:
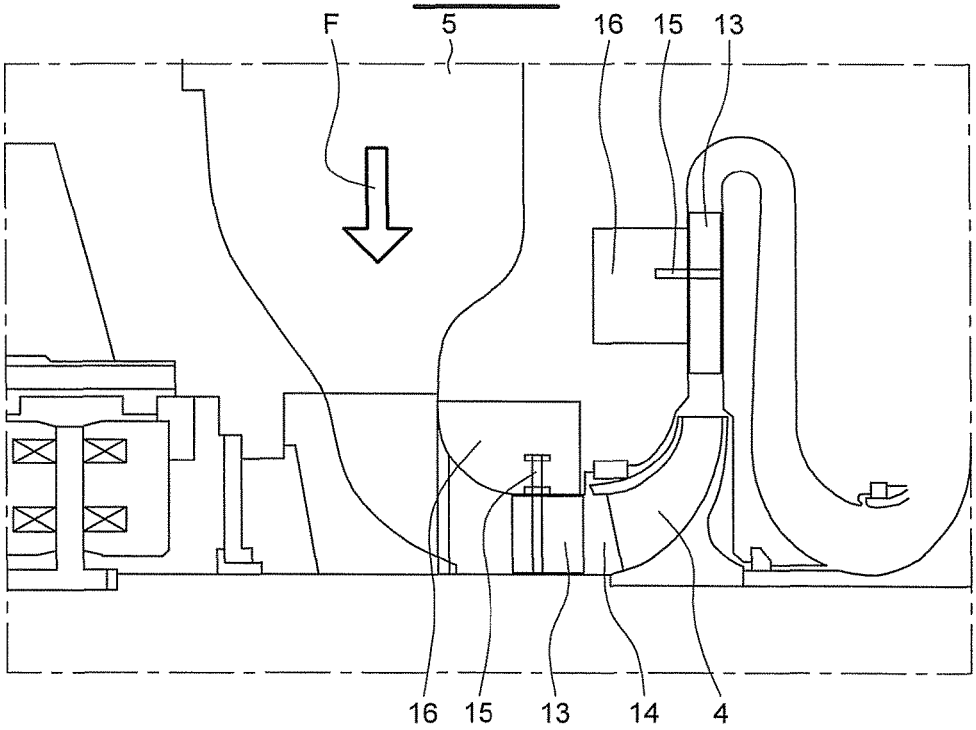
FIG. 3 illustrates an embodiment variant of the compressor unit of FIG. 2.

It will be noted that the compression stage comprises, in succession, between the inlet 5 and the outlet 5', a supply zone A, the centrifugal impeller 4 and the diffuser D. It will be noted that the aerodynamic member 13 here is positioned upstream of the impeller 4. It would also be possible, according to the variant illustrated in FIG. 3, for it to be situated in the region of the diffuser.

Figure 4:
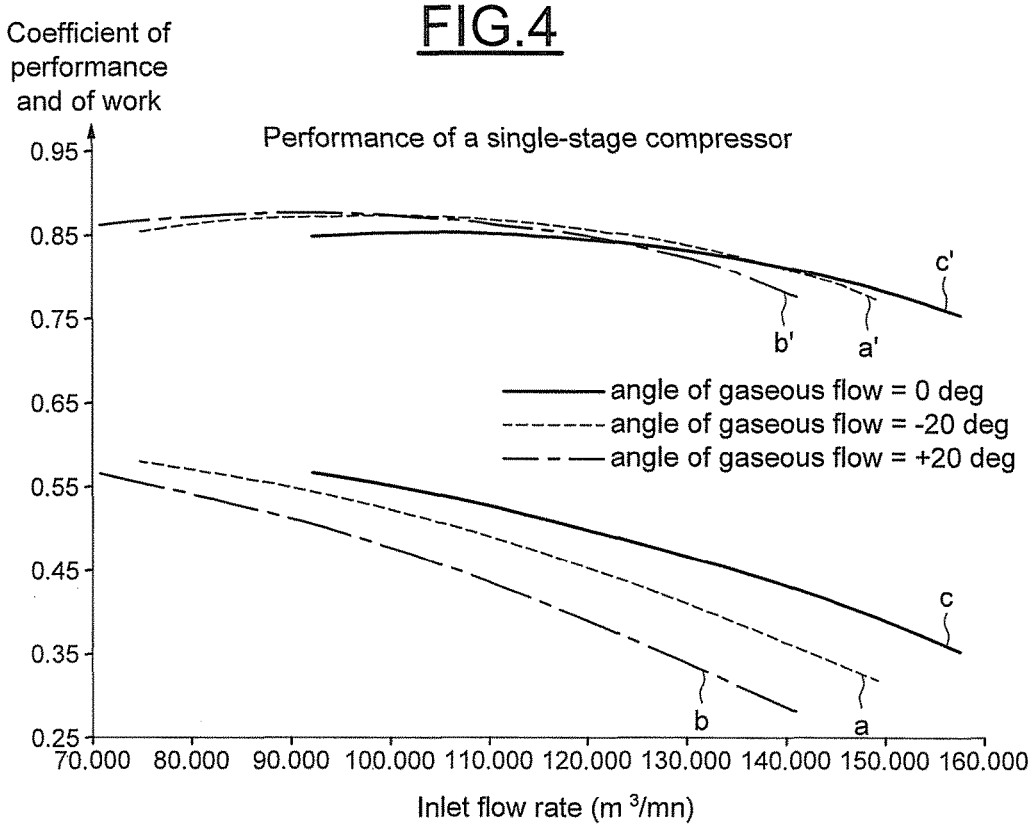
FIG. 4 is a curve showing the change in power and work developed by the compressor unit as a function of the admitted gas flow rate.

With reference to FIG. 4, which depicts the change in work developed by the compressor (curves a, b, c) on the one hand, and in the performance (curves a', b' and c') on the other, as a function of the flow rate admitted at inlet to the motorcompressor unit, it is possible to maximize the aerodynamic performance of the compressor by using the variable pitch setting thereby enjoying a wider range of flow rates.

In particular, in terms of the developed work, starting out from an original position (curve a) in which the vane 13 extends across the overall axis of the flow passage of gas through the compressor, it is possible, by varying the angular position of the vane, to modify the angle of the gaseous flow and thereby modify the flow rate for the same pressure value.

In other words, it is found that modifying the angle of incidence of the gaseous flow allows the operating curve of the compressor to be shifted translationally, thereby adapting its operating range.

Moreover, the motor 1 and the compression stage 3 are arranged in one and the same casing 12 that is sealed against the gas being handled, which means that the inside of the motorcompressor unit, particularly the motor 1 and at least the compression stage 3, are immersed in the gas that is being handled, at the pressure of the gas entering via the supply pipe 5. The inside of the motorcompressor has no shaft output sealing packing because the shafts bearing the motor 1 and bearing the bladed impeller 4, and the bearings that support them, are fully contained within the casing. The motorcompressor unit has only rotary seals subjected to small pressure differences, for example seals of the labyrinth seal type. No leak of process gas to the atmosphere can therefore occur, because the openings in the casing are confined to the gas supply pipe 5, the gas outlet pipe 5', the lead-throughs for the cables that control and power the motors 1 and 16, and the periphery of a cover (not depicted) that allows the various components to be inserted into the casing. Further, in order to limit ventilation losses, the motor 1 is subject to the intake pressure set up at the supply pipe 5. A circulation of gas can moreover be set up in order to cool it.

One particularly advantageous application of the invention is in gas transfer stations in which the pressure ratios that have to be developed between the intake and delivery sides are relatively small, notably below 2, and for which the motorcompressor units are preferably single-stage units or, in general, comprise fewer than three stages. Specifically, for this type of application, it is often desirable to have a relatively wide range of flow rates so that small or large flow rates can be offered.

However, of course, any other application in which it is desirable to have a relatively wide range of flow rates may also be envisaged.

It will moreover be noted that the use of an aerodynamic member for controlling the angle of incidence of the gas flow is advantageous for motorcompressor units comprising from 1 to 3 compression stages. However, such a member may advantageously be installed in single-stage motorcompressor units. However, when using a multi-stage compressor, the aerodynamic member can be mounted either on the first compression stage or on all the stages.

As indicated earlier, the aerodynamic member can be mounted either at the inlet to the compression bladed impeller, so as to modify the angle of incidence of the gas flow handled by the bladed impeller, or at the diffuser so as to modify the deceleration of the gas and thereby modify the operating range. It is also possible, according to another embodiment, to provide one aerodynamic regulating member upstream or at the inlet of the bladed impeller or, in other words, upstream of the compression stage, and one regulating member in the diffuser.

What is claimed is:

1. A motorcompressor unit for compressing a fluid, the motorcompressor unit configured to operate at an inlet fluid pressure of 60 to 80 bar, the motorcompressor unit comprising:

at least a first motor driving a rotation of a rotor;

at least one compression stage comprising at least a bladed impeller mounted on a driven shaft a rotation of which is driven by the rotor, wherein the rotor and the driven shaft are connected by a flexible coupling; and a common casing that is gastight with respect to the fluid compressed by the motorcompressor unit, wherein the at least one compression stage and the first motor are mounted in the common casing subject to a same pressure as that of gas entering the common casing, the first motor and the at least one compression stage are arranged in the common casing such that the first motor and at least part of the bladed impeller of the at least one compression stage are immersed in the fluid compressed by the motorcompressor unit, and the at least one compression stage further comprises at least two regulating members, wherein a first regulating member is positioned at an inlet that is upstream to the bladed impeller to modify an angle of incidence of the fluid to the bladed impeller, and a second regulating member positioned at a diffuser attached downstream to the bladed impeller to modify deceleration of the fluid, so as to shift an optimum flow operating range of the motorcompressor unit, and the at least one compression stage further comprises an electrically-powered second motor connected to each of the two regulating members for controlling each of the two regulating members, the electrically-powered second motors being mounted in the common casing.

2. The motorcompressor unit according to claim 1, wherein at least one vane of at least one of the regulating members is arranged across a diameter of a gas guiding passage for the fluid being compressed.

3. The motorcompressor unit according to claim 2, wherein the at least one compression stage comprises between one and three compression stages, wherein at least one compression stage comprises the at least two regulating members.

4. The motorcompressor unit according to claim 2, wherein stages of the at least one compression stage comprise, in succession, in a direction in which the compressed fluid flows, a fluid supply zone, the bladed impeller, and the diffuser, wherein the first regulating member is arranged upstream of the bladed impeller.

5. The motorcompressor unit according to claim 2, wherein stages of the at least one compression stage comprise, in succession, in a direction in which the compressed fluid flows, a fluid supply zone, the bladed impeller, and the diffuser, wherein the second regulating member is arranged in the diffuser.

6. The motorcompressor unit according to claim 2, further comprising an electronic control unit external to the common casing and connected to the electrically-powered second motors by supply and control cables that pass through the common casing at fluidtight lead-throughs.

7. The motorcompressor unit according to claim 2, further comprising only one compression stage, wherein the compression stage comprises one of the at least two regulating members.

8. The motorcompressor unit according to claim 2, wherein each of the at least one vane has a length shorter than or equal to half a diameter of the gas guiding passage.

9. The motorcompressor unit according to claim 1, wherein the at least one compression stage comprises between one and three compression stages, wherein at least one compression stage comprises the at least two regulating members.

10. The motorcompressor unit according to claim 9, wherein stages of the at least one compression stage comprise, in succession, in a direction in which the compressed fluid flows, a fluid supply zone, the bladed impeller, and the diffuser, wherein the first regulating member is arranged upstream of the bladed impeller.

11. The motorcompressor unit according to claim 9, wherein stages of the at least one compression stage comprise, in succession, in a direction in which the compressed fluid flows, a fluid supply zone, the bladed impeller, and the diffuser, wherein the second regulating member is arranged in the diffuser.

12. The motorcompressor unit according to claim 9, further comprising an electronic control unit external to the common casing and connected to the electrically powered second motors by supply and control cables that pass through the common casing at fluidtight lead-throughs.

13. The motorcompressor unit according to claim 1, wherein stages of the at least one compression stage comprise, in succession, in a direction in which the compressed fluid flows, a fluid supply zone, the bladed impeller, and the diffuser, wherein the first regulating member is arranged upstream of the bladed impeller.

14. The motorcompressor unit according to claim 13, further comprising an electronic control unit external to the common casing and connected to the electrically-powered second motors by supply and control cables that pass through the common casing at fluidtight lead-throughs.

15. The motorcompressor unit according to claim 1, wherein stages of the at least one compression stage comprise, in succession, in a direction in which the compressed fluid flows, a fluid supply zone, the bladed impeller, and the diffuser, wherein the second regulating member is arranged in the diffuser.

16. The motorcompressor unit according to claim 1, further comprising an electronic control unit external to the common casing and connected to the electrically-powered second motors by supply and control cables that pass through the common casing at fluidtight lead-throughs.

17. The motorcompressor unit according to claim 1, configured to provide a pressure ratio between 1 and 2 between an intake and a delivery.

18. The motorcompressor unit according to claim 1, further comprising only one compression stage, wherein the compression stage comprises one of the at least two regulating members.

19. A motorcompressor unit for compressing a fluid, the motorcompressor unit configured to operate at an inlet fluid pressure of 60 to 80 bar, the motorcompressor unit comprising:

at least a first motor driving a rotation of a rotor;

at least one compression stage comprising at least one bladed impeller mounted on a driven shaft a rotation of which is driven by the rotor, the at least one compression stage further comprising at least one regulating member positioned at an inlet that is upstream to the bladed impeller to modify an angle of incidence of the fluid to the bladed impeller, or at a diffuser attached downstream to the blade impeller to modify deceleration of the fluid, so as to shift an optimum flow operating range of the motorcompressor unit, and the at least one compression stage further comprising an electrically-powered second motor connected to the at least one regulating member for controlling the at least one regulating member; and a common casing that is gastight with respect to the fluid compressed by the motorcompressor unit, wherein the at least one compression stage, the first motor and the electrically-powered second motor are mounted in the common casing, wherein the at least one compression stage, the first motor and the electrically-powered second motor are arranged in the common casing such that at least part of the bladed impeller of the at least one compression stage, the first motor and the second motor are immersed in the fluid compressed by the motorcompressor unit subject to a same pressure as that of gas entering the common casing.

20. A motorcompressor unit for compressing a fluid; the motorcompressor unit comprising:

at least a first motor driving a rotation of a rotor;

at least one compression stage comprising at least a bladed impeller mounted on a driven shaft a rotation of which is driven by the rotor, wherein the rotor and the driven shaft are connected by a flexible coupling; and a common casing that is gastight with respect to the fluid compressed by the motorcompressor unit, wherein the at least one compression stage and the first motor are mounted in the common casing subject to a same pressure as that of gas entering the common casing, the first motor and the at least one compression stage are arranged in the common casing such that the first motor and at least part of the bladed impeller of the at least one compression stage are immersed in the fluid compressed by the motorcompressor unit, and the at least one compression stage further comprises at least two regulating members, wherein a first regulating member is positioned at an inlet that is upstream to the bladed impeller to modify an angle of incidence of the fluid to the bladed impeller, and a second regulating member positioned at a diffuser attached downstream to the bladed impeller to modify deceleration of the fluid, so as to shift an optimum flow operating range of the motorcompressor unit, and the at least one compression stage further comprises at least two electrically-powered second motors connected respectively to each of the at least two regulating members for controlling each of the at least two regulating members, the at least two electrically-powered second motors being mounted in the common casing, wherein each of the at least two electrically-powered second motors comprise a power cable that pass through the common casing at fluidtight lead-throughs.

* * * * *